United States Patent [19]

Schiltz et al.

[11] 4,403,652

[45] Sep. 13, 1983

[54] PLATE HEAT EXCHANGER

[75] Inventors: Ronald M. Schiltz; Alan H. Corlett, both of Lake Mills, Wis.

[73] Assignee: Crepaco, Inc., Lake Mills, Wis.

[21] Appl. No.: 249,855

[22] Filed: Apr. 1, 1981

[51] Int. Cl.[3] ..... F28F 3/12; F28F 3/10

[52] U.S. Cl. ..... 165/167; 165/170

[58] Field of Search ..... 165/167, 170

[56] References Cited

U.S. PATENT DOCUMENTS

| | | | |
|---|---|---|---|
| 1,992,097 | 2/1935 | Seligman | 165/167 |
| 2,300,663 | 11/1942 | Fette | 165/167 |
| 2,981,520 | 4/1961 | Chadburn | 165/170 |
| 3,532,161 | 10/1970 | Lockel | 165/167 |
| 4,150,720 | 4/1979 | Brackman | 165/170 |

FOREIGN PATENT DOCUMENTS

| | | | |
|---|---|---|---|
| 849444 | 11/1939 | France | 165/167 |
| 327377 | 4/1930 | United Kingdom | 165/167 |
| 1109697 | 4/1968 | United Kingdom | 165/170 |

*Primary Examiner*—Albert W. Davis, Jr.

*Assistant Examiner*—S. Gayle Dotson

*Attorney, Agent, or Firm*—Neuman, Williams, Anderson & Olson

[57] ABSTRACT

A plate heat exchanger is provided which includes a plurality of plates mounted in abutting face-to-face relation. Interposed adjacent plates is a sealing gasket. The plates are held in assembled relation by an adjustable press. Each plate is provided with an extruded first section having second sections secured to opposite peripheral segments thereof. Each section is provided with broad opposed exterior surfaces. The first section has a plurality of internal passages formed therein defining first flow-paths for a first heat exchange medium. The opposed broad exterior surfaces of adjacent plates coact with the sealing gasket to define second flow-paths for a second heat exchange medium. The pressure exerted on the plates by the press to maintain same in abutting relation is determined by the maximum pressure generated by the second heat exchange medium within the second flow-paths during operation of the plate heat exchanger.

7 Claims, 7 Drawing Figures

Fig. 4.
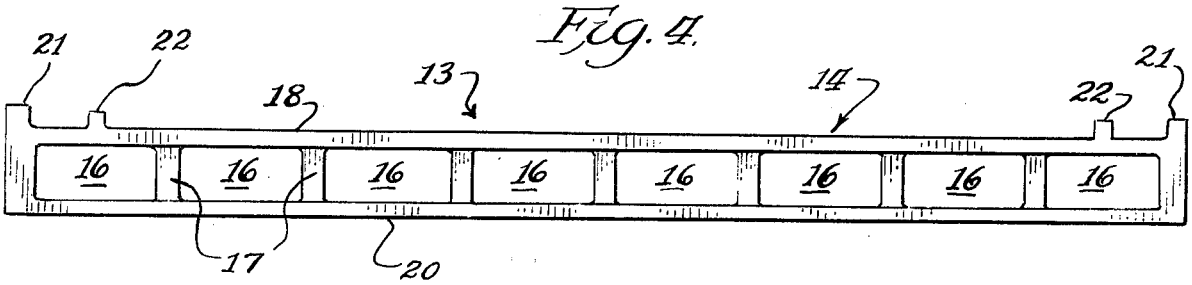
Fig. 5.
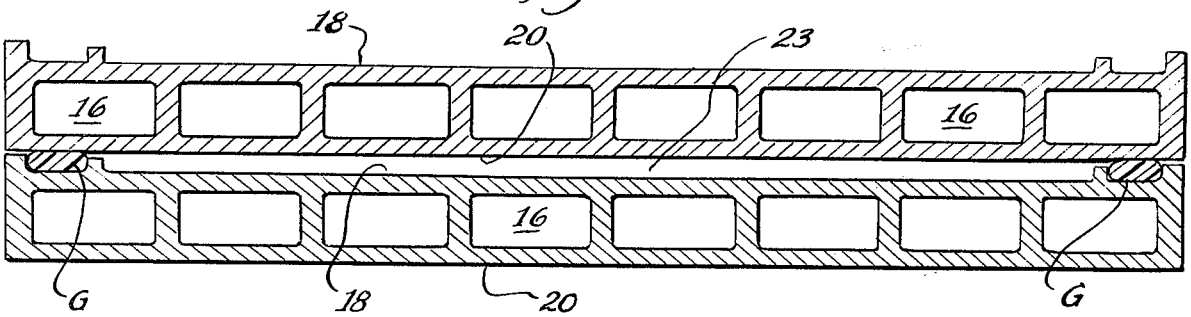
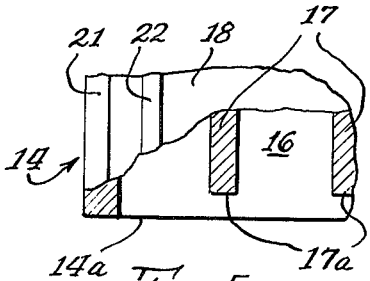
Fig. 5a
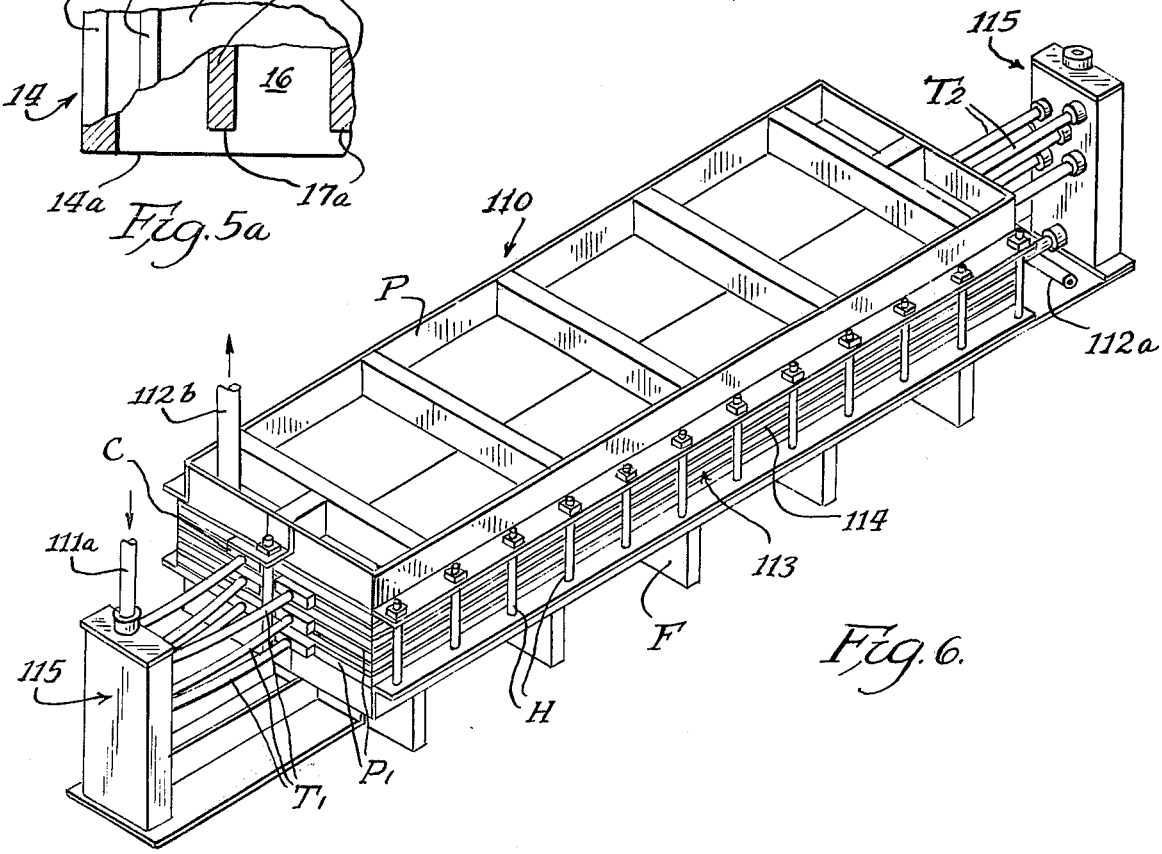
Fig. 6.

PLATE HEAT EXCHANGER

BACKGROUND OF THE INVENTION

The utilization of plate heat exchangers in many commercial or manufacturing operations has markedly increased over the years because of the numerous inherent advantages possessed by plate heat exchangers as compared to other types of heat exchange equipment (e.g., shell and tube). Some of the inherent advantages include (a) versatility and flexibility to effectively meet various heat exchange demands; (b) improved control of end or terminal temperature differences; (c) varying the number of plates to increase or decrease capacity; (d) restreaming or rearranging the flow-paths so as to better control pressure drops; and (e) reduce maintenance costs.

While the inherent advantages are numerous, prior plate exchangers are nevertheless beset with one or more of the following shortcomings: (1) plate warpage; (2) the plates are costly to manufacture because of the need for corrugations, dimples, buttons, or the like to be formed therein in order to maintain the desired spacing between adjacent plates; (3) an inordinate amount of entrapment or incrusting of particulates occurs within the flow-paths because of the size, shape, and number of the spacers disposed within the flow-paths; thereby, seriously impeding flow therethrough; (4) special gasket and bonding materials are required to assure proper sealing between the plates during operation of the exchanger; (5) the plates can only be mounted in one relative position, thereby restricting placement of the heat exchanger at only one location on the job site; and (6) because of problems regarding structural integrity, the length of each plate was restricted (e.g., not more than eight feet) thereby reducing the percentage regeneration capability of the plate.

SUMMARY OF THE INVENTION

Thus, it is an object of the invention to provide an improved plate heat exchanger which is not beset with the aforenoted shortcomings.

It is a further object to provide an improved plate heat exchanger wherein the plates thereof may be readily formed to any length desired and mounted in a variety of relative positions (e.g., flat horizontal; on edge-horizontal; on edge-vertically; tilted to effect optimum condensate drainage end-to-end).

It is a further object to provide an improved plate heat exchanger wherein substantially the whole, or significant portions, of the plates are extruded thereby providing internal passages having highly desirable structural strength and an integrity of shape, even under temperatures and pressure which vary over a wide range.

It is a still further object to provide an improved plate heat exchanger wherein the pressure required to maintain the plates in proper abutting face-to-face relation is substantially less than normally required.

It is a still further object to provide an improved plate heat exchanger wherein the plates thereof are substantially non-flexible thereby greatly facilitating the installation, maintenance, and servicing of the exchanger.

Further and additional objects will appear from the description, accompanying drawings, and appended claims.

In accordance with one embodiment of the invention an improved plate heat exchanger is provided which includes a plurality of plates mounted in abutting face-to-face relation. Each plate is provided with internal passages defining first flow-paths for a first heat exchange medium. Adjacent plates coact to form passages defining second flow-paths for a second heat exchange medium. The first and second flow-paths are independent of one another with separate inlet and outlet means therefor so as to allow counter-flow of the media throughout the exchanger. Sealing gasket means are interposed adjacent plates. Each plate includes an extruded first section having the internal passages formed therein and arranged in side-by-side relation. Second sections are disposed at opposite peripheral segments of the plate first section and are provided with the inlet and outlet means. The first and second sections have broad, opposed, exterior surfaces which coact with the sealing gasket means to define the second flow-paths.

DESCRIPTION

For a more complete understanding of the invention reference should be made to the drawings wherein:

FIG. 4 is an enlarged end view of the first section of the plate of FIG. 2.

FIG. 5 is an enlarged vertical sectional view of a pair of plates arranged in abutting face-to-face relation.

Figures 1, 2, 3:
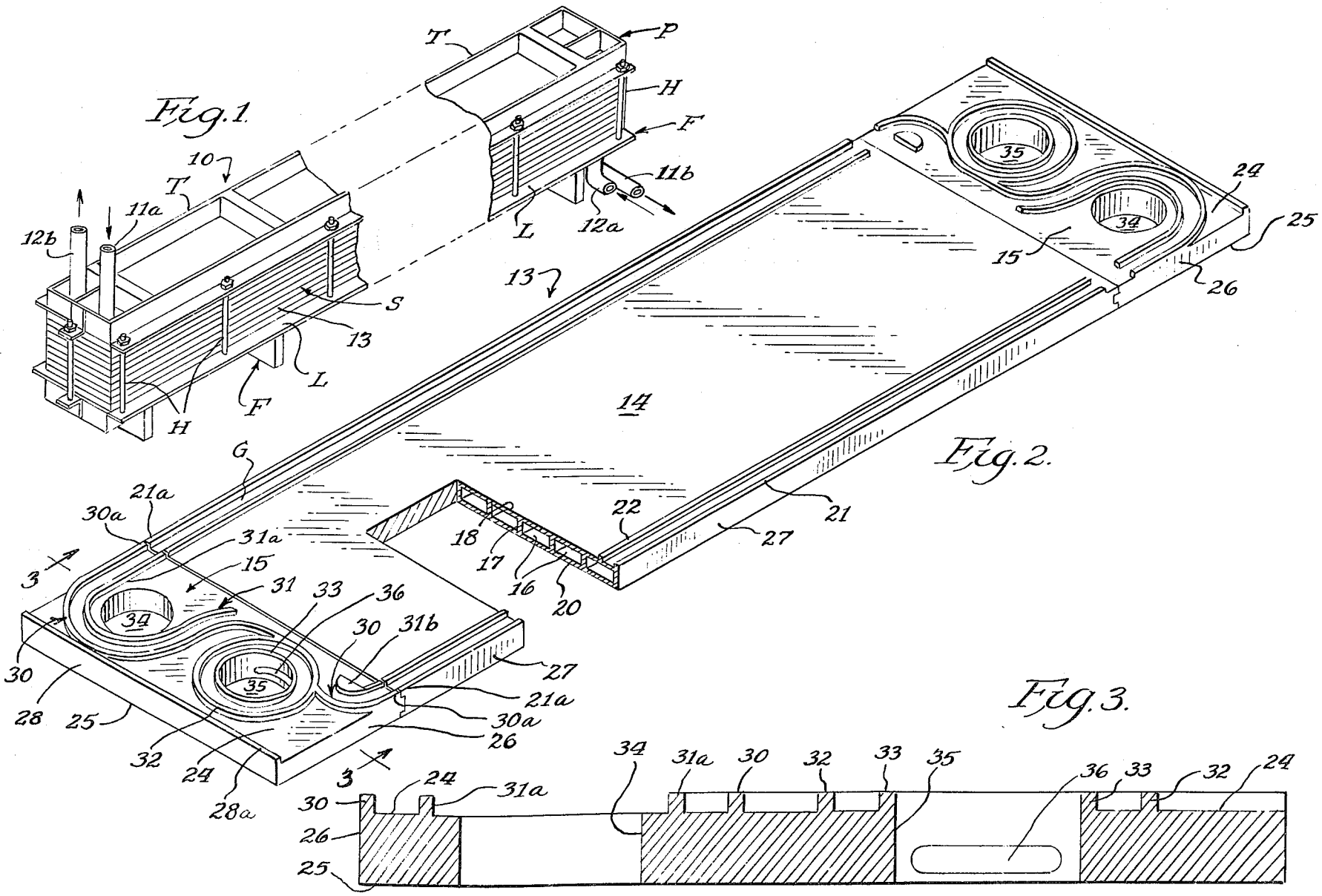
FIG. 1 is a fragmentary perspective view of one form of the improved plate heat exchanger.
FIG. 2 is an enlarged perspective view of one of the plates embodied in the plate heat exchanger of FIG. 1; a portion of the plate being cut away to expose the internal passages formed therein.
FIG. 3 is an enlarged sectional view taken along line 3—3 of FIG. 2.

FIG. 5*a* is a fragmentary top plan view of one end of the corner section of a heat exchanger plate; a portion of the top surface of the section is removed so as to reveal the section interior.

FIG. 6 is a perspective view of a second form of the improved plate heat exchanger.

Referring now to the drawings and more particularly to FIG. 1, one form of the improved heat exchanger 10 is shown which is adapted for use in a dairy plant or the like. The exchanger 10 is provided with suitable inlet and outlet connections 11*a-b* and 12*a-b*. Connections 11*a-b* are provided for a first heat exchange medium (e.g., steam or ammonia) and connections 12*a-b* are provided for a second heat exchange medium (e.g., milk, water, etc.). By way of example, the first medium may have a working pressure of approximately 275 p.s.i.g. and the second medium may have a working pressure of 100 p.s.i.g. The types of heat exchange medium and the working pressures thereof may vary over a wide range. Normally, however, the designed working pressure for the first heat exchange medium would be about 300 p.s.i.g. and that of the second heat exchange medium would be about 125 p.s.i.g.

Heat exchanger 10 also includes a plurality of individual elongated plates 13, see FIG. 2, which, in the illustrated embodiment, are horizontally disposed and stacked in abutting face-to-face relation. The number of plates comprising the stack S and the size and length of each plate will depend upon the operation requirements of the system in which the plate heat exchanger is installed. The stack of plates are subtended by the lower portion L of a supporting frame F and the top of the stack is engaged by the top portion T of the frame. The periphery of the frame top portion T is adjustably secured to the periphery of frame lower portion L by a plurality of symmetrically arranged hold-down nut and bolt units H. The pressure exerted on the stack by the frame top portion can be carefully determined by the use of a conventional torque wrench or the like.

As seen in FIG. 5, a sealing gasket G is interposed each pair of plates comprising the stack S. The gasket may be formed of various types of materials commonly utilized for this purpose and must be capable of withstanding the temperatures and pressures to be encountered when the medium flows within the passages formed between adjacent plates. Furthermore, the gasket material must be inert to such heat exchange medium.

Each plate 13 in exchanger 10 is preferably of like construction, and as seen in FIG. 2, includes a first, or center section 14 which is extruded from a suitable material (e.g., aluminum) having high thermal conductivity; high structural strength; and is not deleteriously affected by the heat exchange media.

Secured by welding or the like to opposite ends of the center section 14 are header, or second, sections 15 which preferably are precision castings and of like configuration.

Center section 14, as seen in FIGS. 4 and 5, has formed therein a plurality of elongated passages 16 arranged in spaced, substantially parallel relation. Adjacent passages are separated from one another by a web 17 which extends from a broad top surface 18 to a broad bottom surface 20 of the section 14. The passages 16 are preferably of like configuration and are coextensive with one another. Each passage is relatively straight and has substantially smooth wall surfaces which do not impeded or encumber flow of the heat exchange medium through the passage. By reason of this construction, there is a minimal pressure drop as the heat exchange medium flow through the passage and a closer terminal-to-terminal temperature control can be achieved. In view of the self-contained strength of the extruded section 14, the top and bottom surfaces 18, 20 thereof remain stable thereby avoiding a serious warpage problem, which is common in many prior plate heat exchangers. As previously noted, such prior plate heat exchangers have attempted to minimize warpage by forming corrugations, dimples, buttons, or the like in either, or both, the top and bottom surfaces and thereby maintain space uniformity between portions of adjacent plates.

As noted in FIG. 5*a*, each web 17 of the center section 14 has the length thereof foreshortened, thereby enabling adjacent passages 16 to be interconnected at their ends for reasons to be explained more fully hereinafter.

Formed along the elongated margin of the top surface 18 of center section 14 are a pair of upwardly protruding elongated ribs 21, 22. The ribs coact to form a substantially channel-shaped retainer-guide pocket for the sealing gasket G. Rib 21 normally projects upwardly a slightly greater distance than rib 22 and thereby more effectively prevents blow-out of the accommodated gasket, when the heat exchanger is in operation. Ribs 21 and 22 provide added stiffness to the plate top surface and also may serve to determine the minimum height of the passage 23 formed between adjacent plates when the stack S is compressed between the frame portions L and T, see FIG. 5. While the ribs 21, 22 are shown formed on the top surface of section 14, they may be formed instead on the bottom surface 20, if desired.

The header sections 15, as illustrated in FIGS. 2 and 3, are of like configuration and may be precision castings. Each header section includes broad top and bottom surfaces 24 and 25, respectively, which are coplanar with corresponding surfaces of the center section. In addition, each header section 15 includes narrow side surfaces 26 which are normally coplanar with corresponding narrow side surfaces 27 of the center section. One end of the header section is closed by a narrow end wall 28. The upper edge of wall 28 forms an upwardly-projecting lip 28*a*. The height of lip 28*a* is substantially the same as that of the ribs 30, 31, 32, 33 also formed on the top surface 24 of the header section. Rib 30 has a serpentine-like configuration with the ends 30*a* thereof substantially aligned with the corresponding end 21*a* of rib 21 formed on the top surface 18 of center section 14.

Rib 31 is interrupted and has one segment 31*a* thereof partially encompassing an enlarged transverse port 34 found in the header section which extends from the top surface 24 to the bottom surface 25. Port 34 communicates with the passages 23 formed between adjacent plates of the assembled stack. Rib 31 also includes a second segment 31*b* which may be substantially crescent shaped. Segment 31*b* has a curved surface substantially aligned with the surface of rib 22 which is adjacent the accommodated gasket. Rib 30 and rib segments 31*a*, 31*b* coact with one another to form a retainer-guide pocket for part of the sealing gasket carried by the center section 14.

Header section 15 is also provided with a second port 35 similar in shape to port 34 but spaced therefrom. Communicating with port 35 and formed intermediate the top and bottom surfaces 24, 25 is an internal secondary port 36 which extends radially from the periphery of port 35 to the adjacent end 14*a* of the center section 14 to which the header is connected. Because the ends 17*a* of the interior webs 17 of the center section are recessed from the center section end 14*a*, port 36 is in communication with all of the internal passages 16 formed in the center section.

Rib 33, which is formed in the top surface 24 of the header section, surrounds an end of port 35. Rib 32 also formed on the top surface 24 is in spaced concentric relation with rib 33 and coacts therewith to form a pocket for an annular second sealing gasket, not shown. The second gasket may be formed of the same material as gasket G.

A modified form of the improved plate heat exchanger 110 is shown in FIG. 6 which is similar to exchanger 10, except that instead of the first heat exchange medium flowing through inlet connection 11*a*, header section 15, center section 14, header section 15 and out through connection 11*b*, the medium enters the passages 16 of the center section 14 through a plurality of individual tubes $T_1$ and is discharged from the center section through a like number of tubes $T_2$. There is a pair of tubes for each plate. Each tube is connected at one end to an external header section 115 which is spaced endwise from a corresponding end plate P', the latter being secured to and overlying the entire end face of the center section 114. The other end of each tube is connected to a connector C which, in turn, is affixed to an exposed portion of the end plate. The connector C is provided with a central opening which is aligned with a suitable opening formed in plate P'. Thus, the first heat exchanger medium will flow to each of the passages 16 because the interior webs 17 have recessed ends 17*a*, as seen in FIG. 5*a*.

Exchanger 110 might be a preferred embodiment where the heat exchange medium flowing through tubes $T_1$, $T_2$ is a toxic product and the latter is contained under high pressure within the header sections 115. If for any reason a leakage of the product should occur at either of the connectors C, such leakage would be to the atmosphere rather than to the other heat exchange medium flowing through passages 23. To facilitate understanding of exchanger 110, the parts thereof which correspond to parts of exchanger 10 have been given the same number, but in a 100 series.

Because of the structural integrity and non-flexing characteristics of the plates 13 and 113, assembly and disassembly of the plates within an exchanger is greatly facilitated. Furthermore, installing, maintaining, or change-out of the various gaskets present no problem because no bonding or glueing of the gaskets is required. In the improved plate heat exchanger, the compressive force required to properly retain the plates in assembled relation need only be greater than the pressure of the heat exchange medium flowing through passages 23. This latter pressure is normally substantially less than the pressure of the medium flowing through passages 16. Thus, by reason of the reduced compressive force required, a broad range of gasket materials may be utilized and the useful life of the gaskets significantly extended.

While the plates 13, 113 in the illustrated embodiments are shown in a flat, horizontal position, they can be disposed on edge (side or end) or they can be tilted so that condensate, if any, will accumulate at the lower end of the plate and be readily drained. Because of this versatility regarding the disposition of the plates, the improved heat exchanger can be placed in the most practical location within a given area. In the improved heat exchanger, an ideal heat transfer condition exists, namely, the heat exchange media are in one pass counter flow relation.

The size, shape, and number of internal passages formed in the plates may vary from that shown without departing from the scope of the invention.

We claim:

1. A plate heat exchanger for accommodating two circulating heat exchange mediums, one of which is at a substantially higher pressure than the other, said heat exchanger comprising a plurality of plates mounted in abutting superposed face-to-face relation and defining first flow-paths for the heat exchange medium having the highest pressure and second flow-paths for the other heat exchange medium, said first and second flow-paths being independent of one another; inlet and outlet means for each flow-path; and compressible sealing gasket means interposed each pair of abutting plates and delimiting the second flow-paths; each plate including an elongated extruded section of heat conductive material, said section having opposed broad planar exterior surfaces, opposite ends of said section being connected to said inlet and outlet means, said section being provided with a plurality of elongated internal coextensive passages spanning the distance between said opposite ends, adjacent passages being separated from one another by continuous narrow webs integral with and interconnecting the opposed broad surfaces, said internal passages forming said first flow-paths; opposed broad surfaces of adjacent plates and said interposed gasket means coacting to form at least one second flow-path; at least one of the opposed broad surfaces being provided with peripheral laterally spaced ribs between which segments of the gasket means are disposed when compressed and are restrained by said ribs from lateral shifting beyond the periphery of said section when the heat exchange medium with the lower pressure is circulated through the second flow-path.

2. The plate heat exchanger of claim 1 wherein each plate includes header sections connected to opposite ends of the extruded section, at least one of said header sections being provided with a pair of ports independent of one another, one port being in communication with the first flow-paths and the second port being in communication with the second flow-paths.

3. The plate heat exchanger of claim 2 wherein each header section includes a broad exterior surface substantially coplanar with the broad surface of said extruded section provided with said gasket-retaining means, the broad surfaces of said header sections being provided with second gasket-retaining ribs, the latter being in alignment with the first-mentioned gasket-retaining ribs.

4. The plate heat exchanger of claim 3 wherein the second gasket-retaining ribs in each header section has a segment thereof separating the ports formed therein.

5. The plate heat exchanger of claim 1 wherein each of the internal passages is of substantially like cross-sectional configuration and is capable of withstanding high internal pressure without distortion.

6. The plate heat exchanger of claim 5 wherein each passage forming a second flow-path has a width substantially equal to the combined widths of the internal passages formed in the extruded section.

7. A plate heat exchanger for accommodating two circulating heat exchange mediums, one of which is at a substantially higher pressure than the other, said heat exchanger comprising a frame having a first portion adjustable towards and away from a second portion; a plurality of plates mounted in abutting superposed face-to-face relation and disposed between the first and second portions of said frame and adapted to be compressed therebetween, said plates defining first flow-paths for the heat exchange medium having the highest pressure and second flow-paths for the other circulating heat exchange medium, said first and second flow-paths being independent of one another; inlet and outlet means for each flow-path; and compressible sealing gasket means interposed each pair of abutting plates and delimiting the second flow-paths; each plate including an elongated extruded section of heat conductive material, said section having opposed broad planar exterior surfaces, opposite ends of said section being connected to said inlet and outlet means, said section being provided with a plurality of elongated internal coextensive passages spanning the distance between said opposite ends, adjacent passages being separated from one another by continuous narrow webs integral with and interconnecting the opposed broad surfaces, said internal passages forming said first flow-paths; opposed broad surfaces of adjacent plates and said interposed gasket means coacting to form at least one second flow-path; at least one of the opposed broad surfaces being provided with peripheral laterally spaced ribs between which segments of the gasket means are disposed when compressed and are restrained by said ribs from lateral shifting beyond the periphery of said section when the heat exchange medium with the lower pressure is circulated through the second flow-path; the compressive force exerted on said plates by the frame first and second portions being depended solely upon the pressure of the circulating heat exchange medium having the lower pressure.

* * * * *